US009527109B2

(12) United States Patent
Margolies et al.

(10) Patent No.: US 9,527,109 B2
(45) Date of Patent: Dec. 27, 2016

(54) COATING PROCESS AND COATED ARTICLE

(71) Applicant: GENERAL ELECTRIC COMPANY, Schenectady, NY (US)

(72) Inventors: Joshua Lee Margolies, Niskayuna, NY (US); Theodore Robert Grossman, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 118 days.

(21) Appl. No.: 13/910,290

(22) Filed: Jun. 5, 2013

(65) Prior Publication Data

US 2014/0363684 A1 Dec. 11, 2014

(51) Int. Cl.
*C23C 4/02* (2006.01)
*B05D 3/14* (2006.01)
(Continued)

(52) U.S. Cl.
CPC . *B05D 3/14* (2013.01); *C23C 4/02* (2013.01); *C23C 4/11* (2016.01); *C23C 4/12* (2013.01);
(Continued)

(58) Field of Classification Search
CPC ..... C30B 23/06; C23C 24/08–24/106; C23C 4/02; C23C 4/105; C23C 4/12; C23C 4/124; C23C 4/127; C23C 4/18; B05D 3/02; B05D 3/0218; B05D 3/0227; B05D 3/0236; B05D 3/0245; B05D 3/14; F01D 5/284; F01D 5/286; F01D 5/288
(Continued)

(56) References Cited

U.S. PATENT DOCUMENTS 3,702,780 A * 11/1972 Withers ..... B05B 13/00 427/229
4,851,188 A 7/1989 Schaefer et al.
(Continued)

FOREIGN PATENT DOCUMENTS

CH 674650 A5 6/1990
DE 4135326 C1 6/1993
(Continued)

OTHER PUBLICATIONS

Richard J. Lewis, Sr., editor; Hawley's Condensed Chemical Dictionary, 12th edition; Van Nostrand Reinhold company, New York; 1993 (no month), excerpt pp. 1036-1037.*
(Continued)

*Primary Examiner* — Marianne L Padgett
(74) *Attorney, Agent, or Firm* — McNees Wallace & Nurick, LLC

(57) ABSTRACT

A coating process and coated article are disclosed. The coating process includes positioning an article relative to an inductor, heating the article with the inductor, then applying a coating material over the article to form a crystalline coating. The heating of the article increases a first temperature of a surface of the article to a second temperature favoring crystal formation. Another coating process includes positioning an article, uniformly heating a surface of the article to a second temperature favoring crystal formation, then applying an environmental barrier coating material over the surface of the article to form a crystalline environmental barrier coating. The application of the environmental barrier coating is performed through air plasma spray deposition. The coated article includes an article having a complex geometry, and a crystalline coating applied on a surface of the article. The crystalline coating includes increased resistant to delamination.

18 Claims, 2 Drawing Sheets

(51) Int. Cl.

| | |
|---|---|
| ***C23C 24/08*** | (2006.01) |
| ***C23C 4/12*** | (2016.01) |
| ***C23C 4/18*** | (2006.01) |
| ***F01D 5/28*** | (2006.01) |
| ***F01D 25/00*** | (2006.01) |

(52) U.S. Cl.
CPC ..... *C23C 4/127* (2013.01); *C23C 4/134* (2016.01); *C23C 4/18* (2013.01); *C23C 24/08* (2013.01); *C23C 24/085* (2013.01); *C23C 24/087* (2013.01); *F01D 5/284* (2013.01); *F01D 5/288* (2013.01); *F01D 25/007* (2013.01); *F05D 2230/312* (2013.01); *Y10T 428/31678* (2015.04)

(58) Field of Classification Search
USPC ..... 427/446–456, 543, 544
See application file for complete search history.

(56) References Cited

U.S. PATENT DOCUMENTS

| | | | | |
|---|---|---|---|---|
| 5,139,824 | A * | 8/1992 | Liburdi | C23C 16/18 427/252 |
| 5,319,179 | A * | 6/1994 | Joecks | B23K 13/015 219/137 R |
| 5,391,404 | A | 2/1995 | Lee et al. | |
| 5,869,146 | A | 2/1999 | McCluskey et al. | |
| 5,891,527 | A | 4/1999 | Turek et al. | |
| 5,891,528 | A | 4/1999 | Turek et al. | |
| 5,902,638 | A * | 5/1999 | Vakil | C23C 16/403 427/248.1 |
| 5,985,205 | A | 11/1999 | Atmur et al. | |
| 5,985,470 | A | 11/1999 | Spitsberg et al. | |
| 6,129,954 | A | 10/2000 | Spitsberg et al. | |
| 6,153,270 | A | 11/2000 | Russmann et al. | |
| 6,221,175 | B1 | 4/2001 | Kurz et al. | |
| 6,254,935 | B1 | 7/2001 | Eaton et al. | |
| 6,296,909 | B1 | 10/2001 | Spitsberg et al. | |
| 6,299,988 | B1 | 10/2001 | Wang et al. | |
| 6,410,148 | B1 | 6/2002 | Eaton, Jr. et al. | |
| 6,468,648 | B1 | 10/2002 | McCluskey et al. | |
| 6,485,848 | B1 | 11/2002 | Wang et al. | |
| 6,517,960 | B1 | 2/2003 | Wang | |
| 6,607,611 | B1 * | 8/2003 | Darolia | C23C 26/00 148/277 |
| 6,630,200 | B2 | 10/2003 | Wang et al. | |
| 6,733,908 | B1 | 5/2004 | Lee et al. | |
| 6,759,151 | B1 | 7/2004 | Lee | |
| 6,844,075 | B1 | 1/2005 | Saak et al. | |
| 6,929,852 | B2 | 8/2005 | Lane et al. | |
| 6,969,555 | B2 | 11/2005 | Meschter et al. | |
| 7,001,679 | B2 | 2/2006 | Campbell et al. | |
| 2002/0157740 | A1 * | 10/2002 | Appel | B21J 1/025 148/670 |
| 2004/0067320 | A1 * | 4/2004 | Spitsberg | C23C 4/18 427/404 |
| 2005/0008780 | A1 * | 1/2005 | Ackerman | C23C 10/08 427/252 |
| 2005/0053467 | A1 * | 3/2005 | Ackerman | C23C 10/02 416/241 R |
| 2005/0072498 | A1 * | 4/2005 | Begg | C22C 27/04 148/562 |
| 2007/0116893 | A1 * | 5/2007 | Zwaap | C23C 8/08 427/587 |
| 2009/0185944 | A1 * | 7/2009 | Hu | C22C 19/057 420/448 |
| 2010/0015359 | A1 * | 1/2010 | Morisaki | C23C 16/46 427/591 |
| 2010/0092699 | A1 * | 4/2010 | Steinlage | H01J 35/08 427/591 |
| 2010/0151145 | A1 * | 6/2010 | Richter | B22F 3/1055 427/543 |
| 2011/0207008 | A1 * | 8/2011 | McAlister | C01B 3/24 429/422 |
| 2012/0288639 | A1 | 11/2012 | Hanrieder | |
| 2013/0189441 | A1 * | 7/2013 | Pabla et al. | 427/453 |
| 2016/0010471 | A1 * | 1/2016 | Pabla | C04B 35/48 428/328 |

FOREIGN PATENT DOCUMENTS

| | | | |
|---|---|---|---|
| DE | 19940458 | A1 | 3/2001 |
| EP | 2522452 | A1 | 11/2012 |
| JP | 09170061 | A | 6/1997 |

OTHER PUBLICATIONS

Machine translation of JP 9-170061 A, by Sawa Masaaki et al., patent published Jun. 1997.*
Machine translation of DE 4135326 by Gunzelman et al., patent published Jun. 1993.*
Formal translation of Gunzelmann et al. (DE 4135 326C1), patent published Jun. 9, 1993.*
European Search Report and Opinion issued in connection with corresponding EP Application No. 14170731.5-1362 on Oct. 14, 2014.
"Warm spraying—a novel coating process based on high-velocity impact of solid particles", Seiji Kuroda, et al., Science and Technology of Advanced Mater. 9 (2008) 03302 (17pp), published Sep. 10, 2008.
"HVAF High Velocity Air-Fuel", HVAF Process Overview, p. 1-10, http://www.hvaf.com/ © 2014 hvaf.com.
"Solutions Flash—Produce excellent quality PWA 257 high-energy plasma sprayed carbide coatings with TriplexPro-210" www.oerlikon.com/metro, info.metco@oerlikon.com, SF-0006.2—TriplePro™-210 High Energy Coatings, © 2014 Derlikon Metco, (Oct. 2014).
"Comparative Study of WC-Cermet Coatings Sprayed via the HVOF and the HVAF Process", L. Jacobs, M.M. Hyland, and M. De Bonte, (Submitted Oct. 13, 1997; in revision form Mar. 6, 1997), Journal of Thermal Spray Technology, vol. 7(2) Jun. 1998, pp. 213-218.

* cited by examiner

COATING PROCESS AND COATED ARTICLE

FIELD OF THE INVENTION

The present invention is directed to coating processes and coated articles. More specifically, the present invention is directed to crystalline coatings.

BACKGROUND OF THE INVENTION

Harsh operating conditions common to various systems can degrade and/or damage a surface of an article. An environmental barrier coating (EBC) is often deposited over the surface of the article to reduce or eliminate the degradation and/or damage. For example, one form of damage includes the degradation of a ceramic matrix composite (CMC) by water vapor in a gas stream. The water vapor reacts with silicon carbide to form silicon hydroxides. One common process of depositing the EBC is through thermal spraying, such as air plasma spraying.

During a conventional air plasma spraying, the EBC is deposited in an amorphous state. In the amorphous state, atoms of the EBC are not arranged in an ordered lattice. To increase performance of the coating, the amorphous structure can be crystallized, or formed into a crystalline structure, by a post-coating heat treatment of the coated article. The crystallization of the coating often produces a volume change in the coating, producing stresses that can lead to defects and/or delamination. The post-coating heat treatment of the article causes the EBC material to expand as the crystalline structure is formed. The expansion of the EBC material can cause various micro-structural defects such as micro-cracks, delamination of the EBC from the article, or a combination thereof. The delamination of the EBC introduces locations for EBC and/or article damage and/or failure.

One method of reducing or eliminating the defects formed during expansion of the EBC material includes extending the post-coating heat treatment to greater than 50 hours; however, this is time consuming and increases production costs. Other methods of avoiding the expansion of the EBC material include the use of an open box furnace to heat the article prior to, and concurrent with EBC deposition, and the use of electrical resistance heating to heat the article prior to, and concurrent with EBC deposition. The open box furnace is not suited to coating components with complex geometry or to a robust manufacturing process. Resistance heating forms non-uniform heating which produces local overheating and melting of regions of the article.

Coating processes and coated articles that do not suffer from one or more of the above drawbacks would be desirable in the art.

BRIEF DESCRIPTION OF THE INVENTION

In one embodiment, a coating process includes positioning an article relative to an inductor, heating the article with the inductor, then applying a coating material over the article to form a crystalline coating. The heating of the article increases a first temperature of a surface of the article to a second temperature favoring crystal formation.

In another embodiment, a coating process includes positioning an article, uniformly heating a surface of the article to a second temperature favoring crystal formation, then applying an environmental barrier coating material over the surface of the article to form a crystalline environmental barrier coating. The application of the environmental barrier coating is performed through air plasma spray deposition.

In another embodiment, a coated article includes an article having a complex geometry, and a crystalline coating applied on a surface of the article. The crystalline coating includes increased resistant to delamination.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are an exemplary coating process and coated article. Embodiments of the present disclosure, in comparison to processes and articles not using one or more of the features disclosed herein, reduce or eliminate delamination of environmental barrier coating (EBC), decrease production time of articles having EBC, decrease production cost of articles having EBC, increase crystallinity of EBC during application of EBC, decrease coating defects, increase coating life, increase coating functionality, or a combination thereof.

Figure 1:
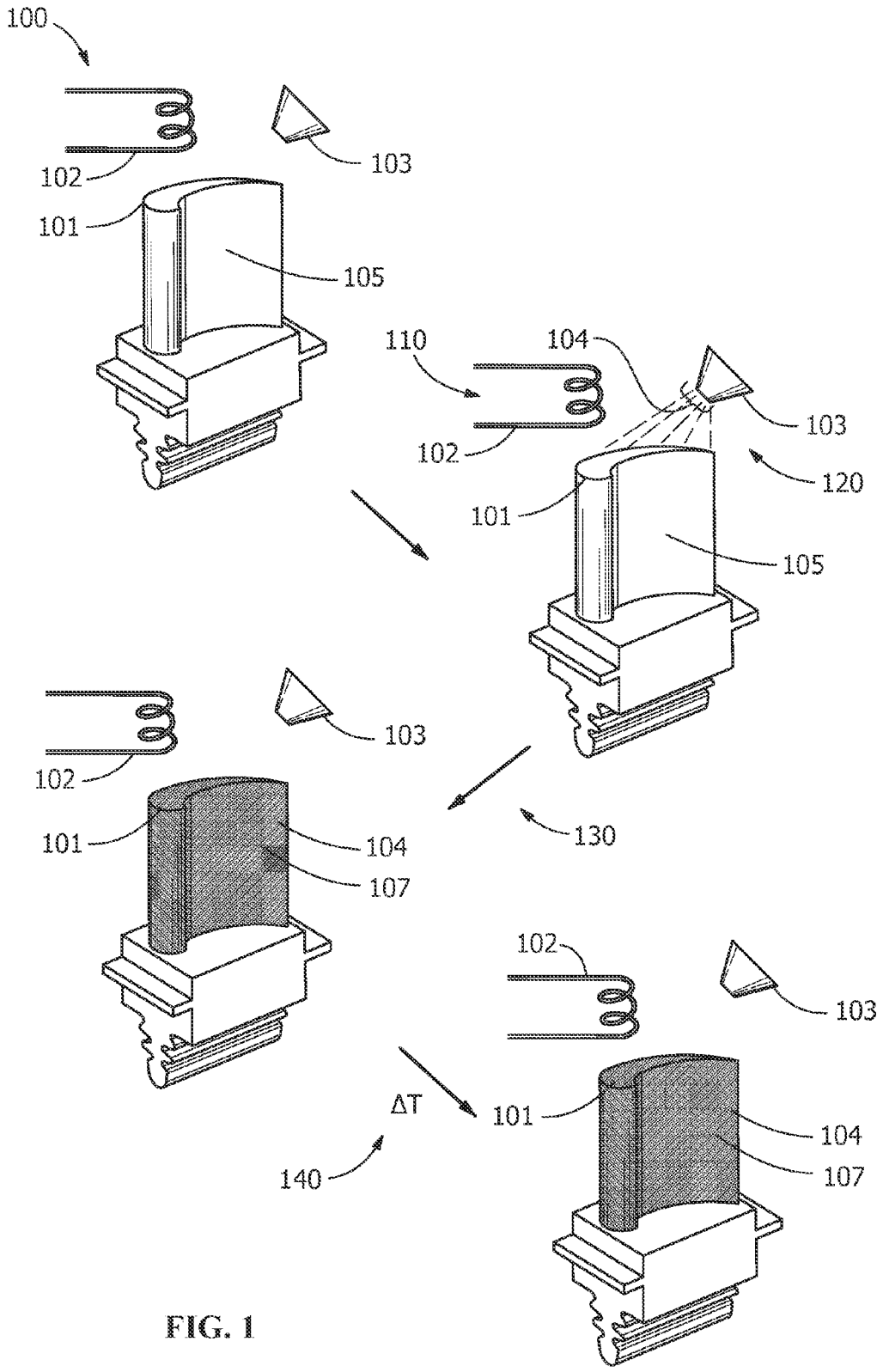
FIG. 1 shows a coating process according to an embodiment of the disclosure.
Figure 2:
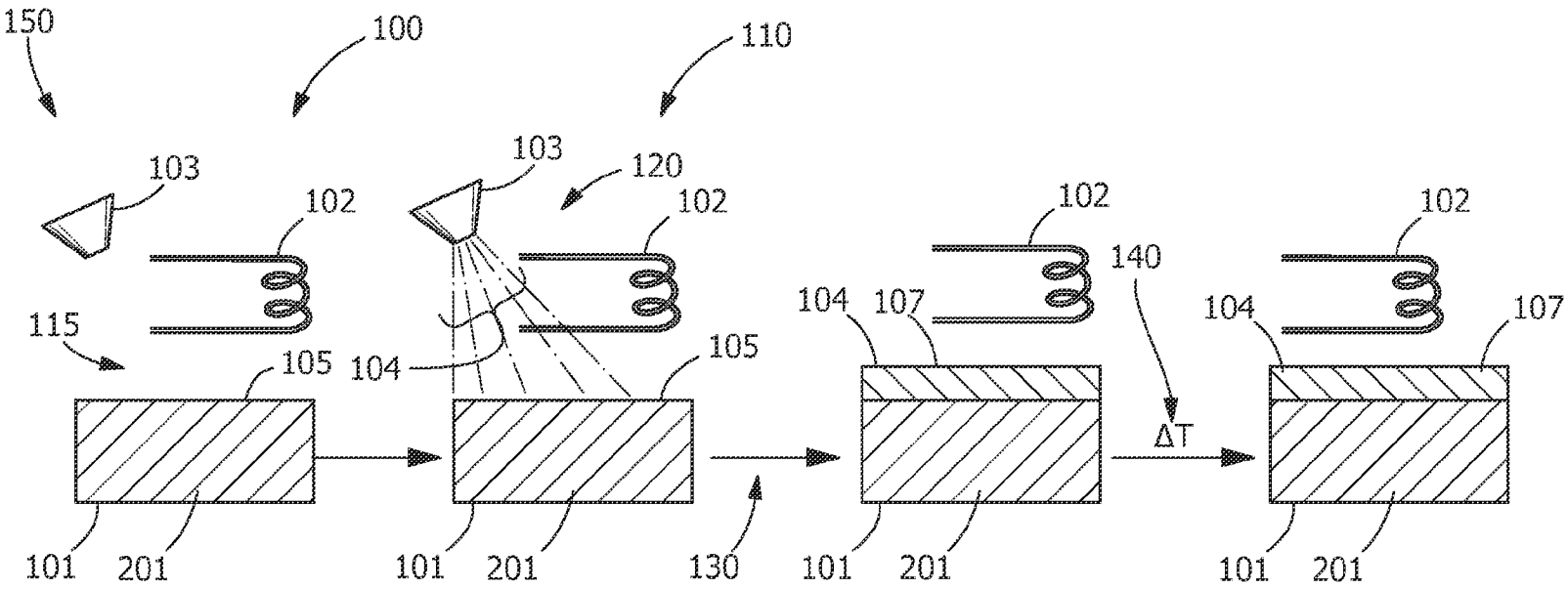
FIG. 2 shows a cross-section view corresponding to the coating process of FIG. 1.

Referring to FIG. 1, in one embodiment, a process 150 includes positioning (step 115) an article 101 relative to an inductor 102, heating (step 100) the article 101 with the inductor 102, then applying (step 120) a coating material 104 over the article 101 to form (step 130) a crystalline coating 107 having an increased amount of crystalline material as compared to amorphous material. The heating (step 100) of the article 101 increases a first temperature of a surface 105 of the article 101 to a second temperature favoring crystal formation. The article 101 is, for example, a turbine bucket, a turbine blade, a hot gas path component, a shroud, a combustion liner, a component having a crystalline coating, any other suitable component, or a combination thereof. The article 101 is detached from a system and/or apparatus prior to a portion or all of the process 150 or remains attached to the system and/or apparatus throughout a portion or all of the process 150.

In one embodiment, the process 150 includes positioning (step 115) the article 101 relative to any suitable energy source capable of increasing the first temperature of the surface 105 to the second temperature favoring crystal formation. Suitable energy sources include, but are not limited to, infrared (IR) sources, torches, inductors 102, or a combination thereof. The inductor 102, as compared to the other energy sources, provide an increased rate of heating (step 100), increased heating (step 100) control, increased resistance to damage from plasma spraying, and decreased cost.

The heating (step 100) is performed prior to and/or concurrently with application (step 120) of the coating material 104, for any suitable duration capable of increasing the first temperature of the surface 105 to the second temperature favoring crystal formation. Suitable durations for the heating (step 100) prior to application (step 120) of the coating material 104 include, but are not limited to, between about 0.0001 hours and about 1 hour, between about 0.005 hours and about 0.95 hours, between about 0.1 hours and about 0.9 hours, between about 0.1 hours and about 0.5 hours, between about 0.05 hours and about 0.2 hours, between about 0.05 hours and about 0.15 hours, or any combination, sub-combination, range, or sub-range thereof.

The heating (step 100) of the article 101 increases the first temperature of the article 101 from an amorphous-crystalline formation temperature to the second temperature favoring crystal formation. The increase in the first temperature of the surface 105 decreases a cooling rate of the coating material 104 applied (step 120) over the surface 105 of the article 101. The decrease in the cooling rate decreases the glass transition temperature (Tg), which permits the coating 104 to re-align into a solid and crystalline lattice arranged in an ordered pattern extending in all spatial directions and having a decreased energy state. The solid and crystalline lattice formation increases a percentage of crystalline structure formed in the crystalline coating 107.

The second temperature favoring crystal formation is any suitable temperature at or above which the application (step 120) of the coating material 104 forms (step 130) the crystalline coating 107. The second temperature favoring crystal formation is adjusted for the coating materials 104 having different compositions to accommodate variations in the amorphous-crystalline formation temperature. Suitable temperatures favoring crystal formation include, but are not limited to, between about 500° C. and about 1500° C., between about 800° C. and about 1200° C., between about 800° C. and about 1000° C., between about 900° C. and about 1200° C., between about 1000° C. and about 1500° C., at least 800° C., at least 1000° C., or any combination, sub-combination, range, or sub-range thereof.

A time/temperature relationship drives multiple thermo-chemical and/or thermo-physical phenomenon to occur. Each thermo-chemical and/or thermo-physical phenomenon impacts how and when the forming (step 130) of the crystalline coating 107 occurs. Increasing the first temperature of a surface 105 prior to or during the application (step 120) of the coating material 104 increases an amount of crystalline material in the crystalline coating 107, in comparison to amorphous material. In one embodiment, the crystalline coating 107 includes little or no amorphous material. For example, heating (step 100) the article to 1,000° C. forms 80% crystalline material in the crystalline coating 107, whereas heating (step 100) the article to 300° C. forms crystalline material in only 7%.

At the second temperature favoring crystal formation, the application (step 120) of the coating material 104 decreases an amount of defects in the crystalline coating 107 and increases a micro-structural stability of the crystalline coating 107. The increase in the micro-structural stability provides increased life and increased functionality of the crystalline coating 107, for example, by reducing or eliminating phase change experienced by coating materials 104 applied at the amorphous-crystalline formation temperature resulting in an amorphous phase.

The application (step 120) of the coating material 104 is by any suitable technique capable of coating the surface 105. The surface 105 has suitable geometry, for example, a complex geometry and/or non-planar profile. As used herein, the term "complex geometry" refers to shapes not easily or consistently identifiable or reproducible, such as, not being square, circular, or rectangular. Examples of complex geometries are present, for example, on the leading edge of a blade/bucket, on the trailing edge of a blade/bucket, on a suction side of a blade/bucket, on a pressure side of a blade/bucket, blade/bucket tip, on a dovetail, on angel wings of a dovetail. Suitable techniques include, but are not limited to, thermal spray (for example, through a thermal spray nozzle 103), air plasma spray, high-velocity oxy-fuel (HVOF) spray, high-velocity air-fuel (HVAF) spray, high-velocity air plasma spray (HV-APS), radio-frequency (RF) induction plasma, direct vapor deposition, or a combination thereof.

In one embodiment, the process 150 includes maintaining (step 110) the second temperature favoring crystal formation at least throughout the application (step 120) of the coating material 104 over the surface 105 of the article 101. The maintaining (step 110) of the second temperature permits reduction or elimination of post-coating heat treatment. Reducing or eliminating the post-coating heat treatment increases manufacturing simplicity, decreases manufacturing cost, reduces or eliminates delamination, reduces or eliminates gap formation, or a combination thereof.

In one embodiment, the forming (step 130) of the crystalline coating 107 is devoid of the post-coating heat treatment. This reduces or eliminates a volume expansion of the coating material 104 experienced during post-coating heat treatments. Reducing or eliminating the volume expansion of the coating material 104 reduces or eliminates delamination of the crystalline coating 107 from the surface 105. For example, a reduced volume expansion level includes, but is not limited to, up to about 0.30%, up to about 0.15%, up to about 0.06%, between about 0.001% and about 0.30%, between about 0.005% and about 0.15%, between about 0.01% and about 0.06%, or any combination, sub-combination, range, or sub-range thereof. In one embodiment, delamination of the crystalline coating 107 exceeding 10 mils is a failure of the crystalline coating 107.

In one embodiment, at least a portion of the forming (step 130) of the crystalline coating includes the post-coating heat treatment (not shown). The post-coating heat treatment is any suitable duration. Suitable durations include, but are not limited to, between about 0.5 hours and about 50 hours, between about 1 hour and about 50 hours, between about 5 hours and about 50 hours, between about 0.5 hours and about 25 hours, between about 1 hour and about 25 hours, between about 0.5 hours and about 15 hours, between about 0.5 hours and about 10 hours, between about 1 hour and about 10 hours, between about 5 hours and about 50 hours, or any combination, sub-combination, range, or sub-range thereof.

In one embodiment, the process 150 includes relative manipulation (not shown) of the inductor 102 and/or the article 101 during the maintaining (step 110) of the second temperature favoring crystal formation. In a further embodiment, the relative manipulation is achieved by being outside of a furnace (not shown), which is capable of being used for the post-coating heat treatment. The relative manipulation permits the application (step 120) of the coating material 104 to be uniform or substantially uniform. The relative manipulation includes methods, such as, but not limited to, rotating, panning, fanning, oscillating, revolving, flipping, spinning, or a combination thereof. In one embodiment, the relative manipulation is performed by an article having any suitable composition capable of withstanding the second temperature favoring crystal formation. Suitable compositions include, but are not limited to, a ceramic, a ceramic matrix composite, a metal, a metal alloy, or a combination thereof.

In embodiments with the application (step 120) of the coating material 104 being uniform, the forming (step 130) of the crystalline coating 107 results in a uniform depth over the surface 105 of the article 101. The uniform depth of the crystalline coating 107 is any suitable depth for a specific coating. Suitable depths of the crystalline coating 107 include, but are not limited to, between about 1 mil and about 2000 mils, between about 1 mil and about 100 mils, between about 10 mils and about 20 mils, between about 20 mils and about 30 mils, between about 30 mils and about 40 mils, between about 40 mils and about 50 mils, between about 20 mils and about 40 mils, between about 0.5 and about 30 mils, or any suitable combination, sub-combination, range, or sub-range thereof.

The coating material 104 is any suitable material capable of being applied to the article 101. Suitable materials include, but are not limited to, thermal barrier coating (TBC) materials, bond coating material, environmental barrier coating (EBC) materials, crystallized coating materials, or a combination thereof. In one embodiment, the TBC materials include, but are not limited to, yttria stabilized zirconia or yttria stabilized halfnate. In one embodiment, the EBC materials include, but are not limited to, barium strontium alumino-silicate (BSAS), mullite, yttria-stabilized zirconia, ytterbium doped silica, rare earth silicates, and combinations thereof. The article 101 includes a composition 201, which is any suitable composition compatible with the coating material 104. Suitable compositions include, but are not limited to, a silicon based ceramic matrix composite, an alloy, a nickel-based alloy, or a combination thereof.

In one embodiment, the process 150 includes cooling (step 140) the article 101 after the forming (step 130) of the crystalline coating 107. Throughout the cooling (step 140) of the article, the crystalline coating 107 is maintained in the crystalline state. In one embodiment, repeating the manipulation of the article 101 and the application (step 120) of the coating material 104 during the maintaining (step 110) of the second temperature favoring crystal formation forms (step 130) a multilayer crystalline coating 107.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A coating process, comprising:

positioning an article relative to and external to an inductor, the article being a turbine component;

heating the article with the inductor while positioned external to the inductor; then applying a coating material over the article to form a crystalline coating, applying the coating material over the article including dispensing the coating material from a material source to the article, the material source being remote from the article, the coating material being selected from the group consisting of a thermal barrier coating material, a bond coating material, an environmental barrier coating material, and combinations thereof, the crystalline coating corresponding to the coating material and being selected from the group consisting of a thermal barrier coating, a bond coating, an environmental barrier coating, and combinations thereof;

wherein the heating of the article increases a first temperature of a surface of the article to a second temperature favoring crystal formation over amorphous formation of the coating material, and the second temperature is maintained by heating with the inductor while applying the coating material.

2. The coating process of claim 1, wherein the crystalline coating is resistant to delamination.

3. The coating process of claim 1, wherein the crystalline coating is applied on a complex geometry of the article.

4. The coating process of claim 1, further comprising manipulating the article relative to the inductor.

5. The coating process of claim 1, further comprising manipulating the inductor relative to the article.

6. The coating process of claim 1, wherein the crystalline coating is formed without a post-coating heat treatment.

7. The coating process of claim 1, further comprising maintaining at least the second temperature favoring crystal formation in the article throughout the application of the coating material over the article.

8. The coating process of claim 1, wherein the article includes a ceramic matrix composite.

9. The coating process of claim 1, wherein the article includes a nickel alloy.

10. The coating process of claim 1, wherein the coating material is an environmental barrier coating material.

11. The coating process of claim 1, wherein phase change of the coating material to an amorphous state during the formation of the crystalline coating is eliminated or reduced in comparison to a comparable coating process at a temperature less than the second temperature.

12. The coating process of claim 1, wherein the forming of the crystalline coating from the applying of the coating material occurs without a volume change.

13. The coating process of claim 1, further comprising depositing the coating material by a method selected from the group consisting of thermal spray, air plasma spray, high-velocity oxy-fuel spray, high-velocity air-fuel spray, high-velocity air plasma spray, and radio-frequency induction plasma.

14. The coating process of claim 1, wherein the crystalline coating includes a coating depth of between 0.5 mils and 30 mils.

15. The coating process of claim 1, further comprising detaching the article from an apparatus prior to applying the coating material.

16. The coating process of claim 1, wherein the article remains attached to an apparatus throughout the depositing of the coating material.

17. The coating process of claim 1, further including a post-coating heat treatment of the article with the crystalline coating formed thereon of less than 50 hours.

18. A coating process, comprising:

positioning an article relative to and external to an energy source comprising an inductor, the article being a turbine component;

uniformly heating while the article is external to the inductor a surface of the article to a second temperature favoring crystal formation over amorphous formation of an environmental barrier coating material; then applying the environmental barrier coating material over the surface of the article at the second temperature to form a crystalline environmental barrier coating of a uniform depth, applying the environmental barrier coating material over the article including dispensing the environmental barrier coating material from a material source to the article, the material source being remote from the article;

wherein the application of the environmental barrier coating is performed through air plasma spray deposition.

* * * * *